US009145756B2

(12) United States Patent
Mackie

(10) Patent No.: US 9,145,756 B2
(45) Date of Patent: Sep. 29, 2015

(54) CONNECTOR SEAL

(75) Inventor: Colin Mackie, Stonehaven (GB)

(73) Assignee: Swellfix B.V., Rijswijk (NL)

( * ) Notice: Subject to any disclaimer, the term of this patent is extended or adjusted under 35 U.S.C. 154(b) by 1000 days.

(21) Appl. No.: 13/260,704

(22) PCT Filed: Mar. 22, 2010

(86) PCT No.: PCT/GB2010/000527

§ 371 (c)(1),
(2), (4) Date: Dec. 20, 2011

(87) PCT Pub. No.: WO2010/112811

PCT Pub. Date: Oct. 7, 2010

(65) Prior Publication Data

US 2012/0080200 A1 Apr. 5, 2012

(30) Foreign Application Priority Data

Apr. 3, 2009 (GB) ..... 0905819.9

(51) Int. Cl.

| | |
|---|---|
| ***B23P 11/00*** | (2006.01) |
| ***B23P 17/04*** | (2006.01) |
| ***E21B 19/16*** | (2006.01) |
| ***F16L 21/00*** | (2006.01) |
| ***E21B 33/127*** | (2006.01) |
| ***E21B 33/12*** | (2006.01) |

(52) U.S. Cl.

CPC ..... *E21B 33/1277* (2013.01); *E21B 33/1208* (2013.01); *Y10T 29/49* (2015.01); *Y10T 29/49947* (2015.01)

(58) Field of Classification Search

CPC . E21B 33/1208; E21B 33/1216; E21B 33/12; E21B 33/1277; E21B 17/105; Y10T 29/49; Y10T 29/49947; Y10S 277/934

USPC ..... 166/387, 118, 179, 380, 241.6; 29/592, 29/525.01; 277/603; 285/369

See application file for complete search history.

(56) References Cited

U.S. PATENT DOCUMENTS

| | | | | |
|---|---|---|---|---|
| 4,266,578 | A * | 5/1981 | Swain et al. | 138/110 |
| 8,127,978 | B2 * | 3/2012 | Castillo et al. | 228/115 |
| 2008/0210418 | A1 * | 9/2008 | Knippa et al. | 166/118 |
| 2009/0260801 | A1 * | 10/2009 | Nutley et al. | 166/118 |
| 2009/0272525 | A1 * | 11/2009 | Nutley et al. | 166/241.6 |

(Continued)

FOREIGN PATENT DOCUMENTS

| | | |
|---|---|---|
| SU | 1170110 | 7/1985 |
| WO | 2004/022911 | 3/2004 |
| WO | 2009/027658 | 3/2009 |

OTHER PUBLICATIONS

International Search Report and Written Opinion for PCT Application No. PCT/GB2010/000527 issued Sep. 29, 2010.

*Primary Examiner* — Daniel P Stephenson
(74) *Attorney, Agent, or Firm* — Meyertons, Hood, Kivlin, Kowert & Goetzel, P.C.; Eric B. Meyertons

(57) ABSTRACT

A seal assembly (10) comprises a sleeve (20) comprising a swellable material, wherein the sleeve (20) is split into at least two sections which are configured to be assembled together on a base member (12). A retaining assembly (28) is provided and configured to hold the sleeve sections on the base member (12). In one disclosed embodiment the retaining assembly (28) straddles a coupling (14) of the base member (12).

27 Claims, 1 Drawing Sheet

(56) References Cited

U.S. PATENT DOCUMENTS

2010/0051295 A1* 3/2010 Courville et al. ..... 166/387
2010/0307771 A1* 12/2010 McRobb et al. ..... 166/387
2011/0056706 A1* 3/2011 Brooks ..... 166/387
2012/0080200 A1* 4/2012 Mackie ..... 166/380

* cited by examiner

CONNECTOR SEAL

FIELD OF THE INVENTION

The present invention relates to a seal assembly, and in particular to a swellable seal assembly.

BACKGROUND TO THE INVENTION

Swellable seals are known for use in many applications and function by swelling to create a seal upon exposure to an activating medium, typically a fluid medium. Such swellable seals are used in the oil and gas industry. For example, downhole swellable seals are known for use in creating annular seals, typically called packers, such as between a tubular and a wall of an open or cased bore. Swellable seals or packers may be used with a variety of oil field tubulars or base pipes, such as casing, liner, production tubulars or the like. Such tubulars or base pipes are typically coupled together, for example via threaded connectors or the like, in end-to-end relation to form a tubing string. Swellable seals may be strategically positioned along the length of the tubing string for a desired purpose, such as for zonal isolation.

A swellable seal may be provided on a tubular by directly bonding a swellable material to the tubular, or alternatively by bonding a swellable material to a sleeve which in turn is installed onto the tubular from one end thereof. In both cases a degree of pre-installation of the seal is typically required prior to employment of the tubular. For example, where the tubular is used to form part of a tubing string the swellable seal is installed before the tubular is connected to the tubing string. In certain circumstances the presence of the pre-installed seal may interfere with tubular handling. For example, the seal may prevent sufficient gripping of the tubular by torquing tools used to screw together adjacent lengths of pipe, lifting mechanisms, or the like.

Preinstalled swellable seals, whether directly bonded to the tubular or provided on sleeves, may suffer from the above noted and other problems due to limited available space on the base tubular. That is, the tubular may be formed or arranged such that a suitable location for a swellable seal is severely restricted, which may prevent the use of a seal altogether. This problem occurs in many situations, and is exemplified in Expandable Sand Screen (ESS) tubulars where the screens may extend over the majority of the surface of the tubular, leaving little space to accommodate a swelling seal in a currently known manner.

Furthermore, the architecture of the tubular or tubing string may make it difficult to appropriately secure a sleeve-type swellable seal against unwanted displacement. Such unwanted displacement may cause damage to other components of a tubular or tubing string, such as a screen material of an ESS tubular.

SUMMARY OF THE INVENTION

According to a first aspect of the present invention there is provided a seal assembly comprising a sleeve comprising a swellable material, wherein the sleeve is split into at least two sections, said at least two sleeve sections being configured to be assembled together on a base member and held on the base member by a retaining assembly.

Accordingly, by providing the sleeve in at least two sections the seal assembly may be assembled and mounted on a base member at a time convenient to the user. This may minimise or eliminate problems associated with a requirement to preinstall a seal on a base member.

The sleeve may be longitudinally split in a direction parallel with the central axis of the sleeve to define the at least two sleeve sections. In this arrangement the sleeve may be defined as being circumferentially split when viewed from an end portion thereof.

In one embodiment the sleeve may comprise two sleeve sections. The sleeve may be evenly split to define two substantially equal sleeve sections. Alternatively, the sleeve may be non-evenly split. The two sleeve sections may be longitudinally split along a plane extending through the central axis of the sleeve. Alternatively, the sleeve may be split along a plane which is misaligned with the central axis of the sleeve.

In other embodiments the sleeve may comprise three or more sleeve sections. The three or more sleeve sections may be evenly or un-evenly split.

The sleeve sections may be formed separately. Alternatively, the sleeve may be formed as a complete component and subsequently split or divided into the required form and number of sleeve sections.

The sleeve sections may be configured to be entirely separable.

At least two sleeve sections may be hingedly or pivotally secured together. In this arrangement the at least two sleeve sections may be opened to be mounted on a base member and subsequently closed around, or at least partially around the base member. The at least two sleeve sections may be closed to fully or partially circumscribe the base member.

One or more of the sleeve sections may be configured to be directly mounted on a base member. One or more of the sleeve sections may be configured to be indirectly mounted on a base member. For example, a further component may be interposed between a sleeve section and the base member.

At least a portion of the retaining assembly may form part of the seal assembly. The retaining assembly may be configured to clamp the sleeve sections against the base member. The retaining assembly may comprise a band member adapted to circumferentially extend around the sleeve. The retaining assembly may comprise a fastening arrangement configured to fasten the sleeve sections together. For example, the retaining assembly may comprise a bolting arrangement, toggle arrangement, buckle arrangement, lever arrangement or the like, or any suitable combination thereof.

At least a portion of the retaining assembly may form part of one or more of the sleeve sections.

At least a portion of the retaining assembly may be formed separately from the sleeve and configured to engage the sleeve sections. The retaining assembly may define a profiled portion configured to correspond to a profile of one or more of the sleeve sections. One or more of the sleeve sections may define a profile configured to correspond to a profile on the retaining assembly. One or more of the sleeve sections and the retaining assembly may define interengaging profiles. The interengaging profiles may assist to prevent axial movement of one or more of the sleeve sections along the base member. The interengaging profiles may assist to permit correct alignment of one or more sleeve sections with each other, and/or with the retaining assembly.

The retaining assembly may be provided to function exclusively to hold the sleeve sections on the base member. The retaining assembly may be provided for multiple functions. For example, the retaining assembly may be configured to protect an element associated with the base member, such as a connector, conduit, cable or the like. The retaining assembly may be configured to function as a centraliser.

The retaining assembly may comprise at least two sections configured to be secured together around the base member. Securing the sections of the retaining assembly together may function to hold the sleeve sections on the base member The at least two sections of the retaining assembly may be secured together by one or more fasteners, such as bolts or the like. The at least two sections may be hinged together.

The sleeve sections may be configured to be assembled on a base member in the region of a connection portion of the base member. The connection portion of the base member may be configured to be connected to a further member via a coupling. The coupling may be a threaded coupling. The retaining assembly may be configured to extend at least partially across the coupling. In this arrangement a region of the coupling may be utilised to accommodate the retaining assembly. This may be advantageous in arrangements where limited space is available on the base member.

The retaining assembly may comprise a cross coupling protector.

The sleeve may be formed entirely of swellable material. Alternatively, a proportion of the sleeve may comprise swellable material. The sleeve may comprise a support structure configured to support the swellable material. The support structure may comprise a metal, metal alloy, composite material or the like. The support structure may define a substantially cylindrical support structure when the sleeve sections are assembled together. The support structure may comprise a solid structure. The support structure may comprise a mesh structure or the like.

The swellable material may be mounted on an outer surface of the support structure. In this arrangement the swellable material may be configured to swell or expand outwardly relative to the sleeve. This may permit a seal to be established between the sleeve and an outer body, such as a bore wall.

The swellable material may be mounted on an inner surface of the support structure. In this arrangement the swellable material may be configured to swell inwardly. This arrangement may permit a seal to be formed between the sleeve and a base member upon which the sleeve is mounted.

In one embodiment the swellable material may be mounted on both the outer and inner surfaces of the support structure.

The swellable material may be adapted to swell by volumetric expansion thereof. Alternatively, or additionally, the swellable material may be adapted to swell by inflation thereof. In embodiments of the invention the swellable material may be adapted to swell upon exposure to an activator. The swellable material may be adapted to be activated by a chemical activator, thermodynamic activator, fluid dynamic activator, radioactive activator or the like, or any suitable combination thereof. For example, the swellable medium may be adapted to be activated by a fluid, such as water, hydrocarbons, cement, drilling mud, or the like, or any suitable combination thereof. Alternatively, or additionally, the swellable material may be adapted to be activated by heat, pressure or the like.

The base member may comprise a tubular.

The base member may comprise a screen material, such as a screen configured for particulate exclusion. The screen material may comprise sand screen, such as expandable sand screen.

The seal assembly may be configured to be mounted on a base member comprising an expandable portion. The seal assembly may be configured to be mounted on the expandable portion of a base member. The seal assembly may be configured to be mounted on a non-expandable portion of a base member.

According to a second aspect of the present invention there is provided a method of installing a seal on a base member, comprising:

providing a sleeve comprising a swellable material, wherein the sleeve is split into at least two sections;

assembling the at least two sleeve sections together on a base member; and holding the sleeve sections on the base member by a retaining assembly.

The seal assembly according to the first aspect may be used in the method according to the second aspect. It should be understood that the uses and description of the seal assembly defined above may equally apply in the present method.

The method may comprise assembling the at least two sleeve sections in the region of a connector or coupling of the base member, wherein the retaining assembly at least partially extends across said coupling.

According to a third aspect of the present invention there is provided a seal assembly comprising:

a sleeve comprising a swellable material, wherein the sleeve is split into at least two sections, said at least two sleeve sections being configured to be assembled together on a base member; and a retaining assembly configured to hold the sleeve sections on the base member.

The features defined above in relation to the first aspect may represent optional features of the seal assembly of this third aspect.

The retaining assembly may comprise a cross coupling protector.

According to a fourth aspect of the present invention there is provided a tubing string comprising:

first and second tubular members connected together via a coupling:

a seal assembly mounted on at least one of the first and second tubular members, wherein the seal assembly comprises a swellable material and is split into at least two sections, said at least two sleeve sections being configured to be assembled together on the tubular member; and a retaining assembly configured to hold the sleeve sections on the tubular member.

The seal assembly may be provided in accordance with the first aspect.

The seal assembly may be provided adjacent the coupling.

The retaining assembly may be configured to extend at least partially across the coupling between the first and second tubular members.

The tubing string may comprise first and second seal assemblies located on a respective first and second tubular member. The first and second seal assemblies may be provided on opposing sides of the coupling. The first and second seal assemblies may be held via a common retaining assembly. Alternatively, or additionally, separate retaining assemblies may be utilised.

According to a fifth aspect of the present invention there is provided a method of assembling a tubing string, comprising:

connecting together first and second tubular members via a coupling:

providing a sleeve comprising a swellable material, wherein the sleeve is split into at least two sections;

assembling the at least two sleeve sections together on at least one of the first and second tubular member; and holding the sleeve sections on the tubular member by a retaining assembly.

According to a sixth aspect of the present invention there is provided a method of manufacturing a seal assembly, comprising:

forming a sleeve comprising a swellable material; and cutting the sleeve to define at least two sleeve sections.

The sleeve may comprise a support structure, wherein the method comprises mounting the swellable material on the support structure.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
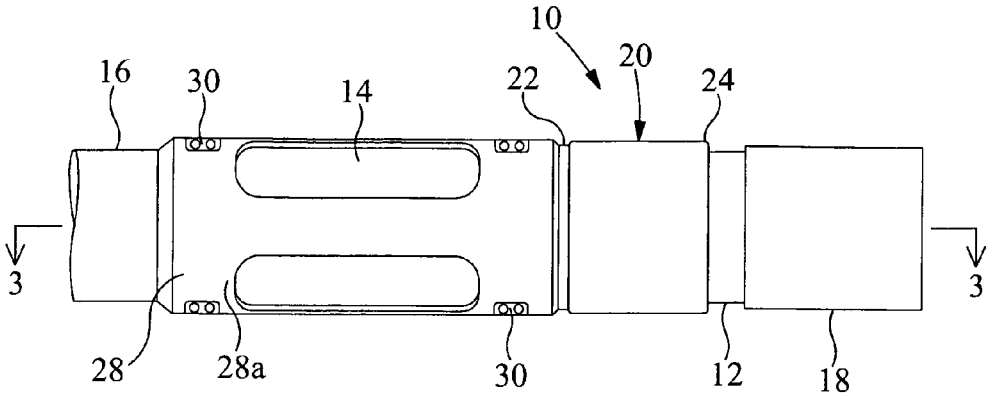
FIG. 1 is a top view of a seal assembly, in use, in accordance with an embodiment of the present invention.
Figure 2:
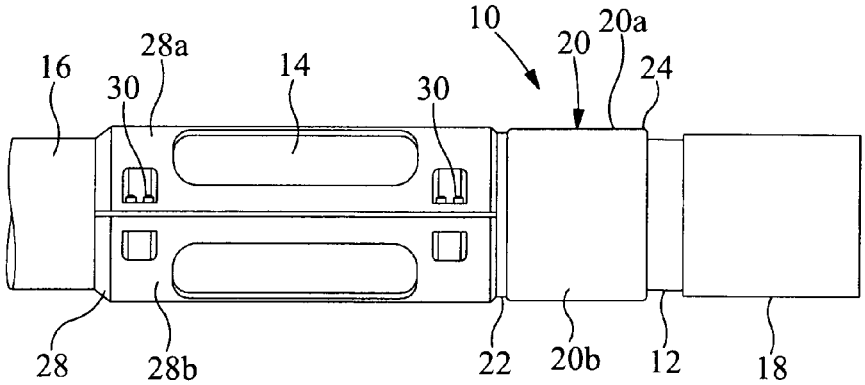
FIG. 2 is a side view of the seal assembly of FIG. 1.
Figure 3:
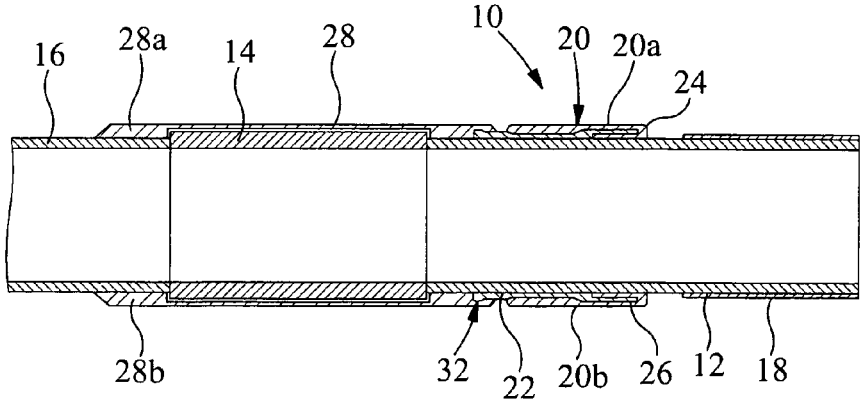
FIG. 3 is a longitudinal cross-sectional view of the seal assembly, taken along line 3-3 of FIG. 1.

A seal assembly, generally identified by reference numeral 10, according to an embodiment of the present invention is shown in use in FIGS. 1 to 3. In FIG. 1 the seal assembly 10 is shown from above, in FIG. 2 from the side, and in cross-section in FIG. 3.

In the present exemplary use, the seal assembly 10 is mounted on a first tubular 12 adjacent a coupling 14 which connects the first tubular 12 to a second tubular 16. The coupling 14 is a threaded coupling. The first tubular 12 comprises Expandable Sand Screen (ESS) 18, which is known in the art. ESS includes a screen material having a number of slits or slots, and the tubular upon which the screen material is mounted typically includes a number of perforations. These slits, slots or perforations are not illustrated. The second tubular 16 may also comprise ESS, but this is not shown for clarity.

In certain arrangements of ESS, as in the example shown, the ESS 18 terminates in close proximity to the coupling 14. This accordingly provides very little room to accommodate a seal, if required, on the tubular 12. In the present embodiment the seal assembly 10 is mounted on the tubular 12 between the ESS 18 and the coupling 14. If this arrangement were provided according to prior known methods and apparatus then the seal would be preinstalled on the first tubular 12 before the connection with the second tubular 16 is made. In this prior art method the presence of the preinstalled seal would not permit the first tubular 12 to be gripped in a conventional manner, for example by torquing tools used to tighten the coupling 14. As will be described in further detail below, the seal assembly 10 of the present invention is arranged such that installation is permitted, but not exclusively permitted, after the connection is made via the coupling 14.

The seal assembly 10 comprises a sleeve 20 which is axially split into two halves or sleeve sections 20*a*, 20*b*, wherein the sleeve sections 20*a*, 20*b* are assembled together on the first tubular 12 to define the complete sleeve 20. This arrangement permits the seal assembly 10 to be installed on the first tubular 12 at a time convenient to the user, for example after a connection is made between the first and second tubulars 12, 16 via the coupling 14.

The sleeve 20, when assembled, comprises a cylindrical support structure 22, which in the embodiment shown is a metallic support structure. A swellable material 24, such as a swellable elastomer, is mounted on the outer surface of the support structure 22. As shown in FIG. 3, the swellable material 24 extends over one axial end 26 of the support structure 22 to be disposed on an inside surface thereof. In use, the swellable material 24 swells upon exposure to an activator, such as water, hydrocarbons or the like. Swelling of the material 24 may be used to define a seal against a wall of a bore (not shown) within which the seal assembly 10 is located, and also to establish a seal between the outer surface of the first tubular 12 and the inner surface of the support structure 22. The seal assembly 10 may be configured to establish a packer, and may be used in a variety of applications, such as in zonal isolation.

Once the sleeve sections 20*a*, 20*b* are assembled on the first tubular 12 they are held in place via a retaining assembly 28. In the embodiment shown the retaining assembly 28 extends across or straddles the coupling 14. The retaining assembly 28 has a form and configuration similar to known cross-coupling protectors. Such known cross-coupling protectors have heretofore been used for protecting cables, conduits, umbilicals or the like which extend across a coupling.

The retaining assembly 28 is axially split into two halves 28*a*, 28*b* which are assembled together over the coupling 14 and secured together via bolts 30. Securing the halves 28*a*, 28*b* together has the effect of clamping the retaining assembly against the first and second tubulars 12, 16 and the coupling 14.

The retaining assembly 28 is configured to overlap one end of the seal assembly 10. Accordingly, securing the halves 28*a*, 28*b* of the retaining assembly together functions to clamp the sleeve sections 20*a*, 20*b* against the first tubular 12. The retaining assembly thus functions to hold the seal assembly together and in place.

Adjacent and overlapping ends of the seal assembly 10 and retaining assembly 28 define an interengaging profile 32 (FIG. 3). This profile 32 may permit correct alignment of the seal assembly 10 and retaining assembly 28, and may prevent axial displacement of the seal assembly 10 relative to the first tubular 12.

It should be understood that the embodiment described herein is merely exemplary and that various modifications may be made thereto without departing from the scope of the invention. For example, a seal assembly may be located on both sides of the coupling. The retaining assembly may retain both seal assemblies, or separate retaining assemblies may be provided.

The seal assembly may be split into more than two sections. The seal assembly may not include a support structure, such that the swellable material is directly mounted on the tubular.

At least portions of the seal assembly and the retaining assembly may be integrally formed.

The retaining assembly may comprise a swellable material. The retaining assembly may function as a protector, for example to protect cables, conduits, umbilicals or the like. The retaining assembly may function as a centraliser.

The individual sections of the retaining assembly may be hinged together. The individual sections of the seal assembly may be hinged together.

The invention claimed is:

1. A seal assembly for a base member comprising a coupling joining a first tubular and a second tubular, the seal assembly comprising:

a sleeve comprising a swellable material, the sleeve being split into at least two sections, said at least two sleeve sections being configured to be assembled together on the base member; and a retaining assembly, wherein securing the retaining assembly to the base member holds the at least two sleeve sections on the base member; and wherein the seal assembly extends at least partially across the coupling.

2. The seal assembly according to claim 1, wherein the sleeve is longitudinally split in a direction parallel with the central axis of the sleeve to define the at least two sleeve sections.

3. The seal assembly according to claim 1, wherein the sleeve sections are formed separately.

4. The seal assembly according to claim 1, wherein the sleeve are formed as a complete component and subsequently split or divided into the required form and number of sleeve sections.

5. The seal assembly according to claim 1, wherein the sleeve sections are configured to be entirely separable.

6. The seal assembly according to claim 1, wherein at least two sleeve sections are hingedly or pivotally secured together, wherein the at least two sleeve sections may be opened to be mounted on a base member and subsequently closed at least partially around the base member.

7. The seal assembly according to claim 1, wherein the retaining assembly is configured to clamp the sleeve sections against the base member.

8. The seal assembly according to claim 1, wherein at least a portion of the retaining assembly is formed separately from the sleeve and configured to engage the sleeve sections.

9. The seal assembly according to claim 1, wherein the retaining assembly defines a profiled portion configured to correspond to a profile of one or more of the sleeve sections.

10. The seal assembly according to claim 1, wherein one or more of the sleeve sections and the retaining assembly define interengaging profiles.

11. The seal assembly according to claim 1, wherein the retaining assembly is configured to function as a centraliser.

12. The seal assembly according to claim 1, wherein the retaining assembly comprises at least two sections configured to be secured together around the base member, wherein securing the sections of the retaining assembly together functions to hold the sleeve sections on the base member.

13. The seal assembly according to claim 1, wherein the retaining assembly is configured to extend at least partially across the coupling.

14. The seal assembly according to claim 1, wherein the retaining assembly comprises a cross coupling protector.

15. The seal assembly according to claim 1, wherein the sleeve comprises a support structure configured to support the swellable material.

16. The seal assembly according to claim 15, wherein the swellable material is mounted on an outer surface of the support structure.

17. The seal assembly according to claim 15, wherein the swellable material is mounted on an inner surface of the support structure.

18. The seal assembly according to claim 1, wherein the base member comprises a screen material.

19. The seal assembly according to claim 1, configured to be mounted on a base member comprising an expandable portion.

20. The seal assembly according to claim 1, wherein at least a portion of the retaining assembly forms part of one or more of the sleeve sections.

21. The seal assembly according to claim 1, wherein at least portions of the seal assembly and the retaining assembly are integrally formed.

22. A method of installing a seal on a base member, comprising:

providing a sleeve comprising a swellable material, wherein the sleeve is split into at least two sections;

providing a base member having a coupling joining a first and a second tubular;

assembling the at least two sleeve sections together on the base member; and securing a retaining assembly together around the base member so as to hold the at least two sleeve sections on the base member, wherein the sealing assembly extends at least partially across the coupling of the base member.

23. The method according to claim 22, wherein the retaining assembly at least partially extends across said coupling.

24. A seal assembly comprising:

a sleeve comprising a swellable material mounted on both the outer and inner surfaces of the sleeve, wherein the sleeve is split into at least two sections, said at least two sleeve sections being configured to be assembled together on a base member, the base member comprising a coupling joining a first tubular and a second tubular; and a retaining assembly;

wherein securing the retaining assembly to the base member holds the at least two sleeve sections on the base member, and wherein the seal assembly extends at least partially across the coupling.

25. A tubing string comprising:

a base member having first and second tubular members connected together via a coupling;

a seal assembly mounted on at least one of the first and second tubular members and extending at least partially across the coupling, wherein the seal assembly comprises a swellable material and is split into at least two sections, said at least two sleeve sections being configured to be assembled together on the tubular member; and a retaining assembly;

wherein securing the retaining assembly to the base member holds the at least two sleeve sections on the base member.

26. The tubing string according to claim 25, wherein the retaining assembly is configured to extend at least partially across the coupling between the first and second tubular members.

27. A method of assembling a tubing string, comprising:

connecting together first and second tubular members via a coupling to form a base member;

providing a sleeve comprising a swellable material, wherein the sleeve is split into at least two sections;

assembling the at least two sleeve sections together on at least one of the first and second tubular members; and holding the sleeve sections on the at least one of the first and second tubular members by a retaining assembly;

wherein the seal assembly extends at least partially across the coupling.

* * * * *